United States Patent [19]

Crise

[11] 4,131,094

[45] Dec. 26, 1978

[54] VARIABLE DISPLACEMENT INTERNAL COMBUSTION ENGINE HAVING AUTOMATIC PISTON STROKE CONTROL

[76] Inventor: George W. Crise, P.O. Drawer A, Danville, Ohio 43014

[21] Appl. No.: 766,207

[22] Filed: Feb. 7, 1977

[51] Int. Cl.[2] ..... F02B 75/04

[52] U.S. Cl. ..... 123/48 B; 123/78 E

[58] Field of Search ..... 127/78 R, 78 BA, 78 E, 127/78 F, 48 B, 48 R

[56] References Cited

U.S. PATENT DOCUMENTS

| | | | |
|---|---|---|---|
| 1,872,856 | 8/1932 | Walker | 123/78 F |
| 1,901,263 | 3/1933 | Rudd | 123/78 F |
| 2,433,639 | 12/1947 | Woodruff et al. | 123/48 B |
| 2,589,958 | 3/1952 | Petit | 123/48 B |
| 2,873,611 | 2/1954 | Biermann | 123/48 B |
| 2,909,164 | 10/1959 | Biermann | 123/48 B |

*Primary Examiner*—Charles J. Myhre
*Assistant Examiner*—David D. Reynolds
*Attorney, Agent, or Firm*—William S. Rambo

[57] ABSTRACT

An internal combustion engine has a crankshaft offset to one side of the axis of the engine cylinder and an articulated connecting rod linkage operable to vary the stroke of the engine piston in accordance with engine operating conditions, so that different density fuel-air charges inducted into the cylinder will be compressed to substantially the same extent each time the cylinder is fired, regardless of throttle setting, engine speeds, or loads.

2 Claims, 10 Drawing Figures

VARIABLE DISPLACEMENT INTERNAL COMBUSTION ENGINE HAVING AUTOMATIC PISTON STROKE CONTROL

BACKGROUND OF THE INVENTION

This invention relates generally to variable stroke, variable displacement, four cycle internal combustion engines. More specifically, the present invention deals with an improved articulated connecting rod linkage and a pressure-responsive control therefor operable to vary the stroke of the engine piston in response to variations of pressures within the fuel induction system of the engine and thereby provide for substantially uniform compression of any fuel charge inducted into the cylinder of the engine prior to firing.

The most pertinent known prior art is typified by U.S. Patent Nos. 2,822,791; 2,873,611; 2,909,163 and 2,909,164 issued to one Arnold E. Biermann. These prior art patents, as well as others, disclose generally the concept of varying the stroke and displacement of an internal combustion engine by utilizing an adjustable articulated connecting rod linkage between the engine piston and the crankshaft. However, the known prior art variable stroke engines are generally characterized by relatively complex, multiple linkage systems which would increase power loss due to added friction and inertia of the multitude of moving parts. Further, so far as the applicant is aware, no one has heretofore proposed an internal combustion engine having an articulated connecting rod linkage which is operable automatically to vary the stroke of the engine piston in accordance with fuel induction pressures so that a low density fuel charge may be compressed to substantially the same pressure at the time of firing as a relatively higher density fuel charge, thereby adding greatly to the efficiency of the engine, particularly during low throttle operations.

As will be well understood by those familiar with internal combustion engine design, present day fixed stroke engines are designed to provide maximum operating efficiency at full or open throttle. That is, the stroke and compression ratio of an internal combustion engine is generally calculated to provide for optimum compression of the denser fuel charges inducted into the engine's cylinder under open throttle conditions. Thus, when the engine throttle is moved to a closed or idle position, the density of the fuel charge inducted into the combustion cylinder is considerably reduced, with the result that the less dense fuel charge will not be compressed to the same, optimum pressure as would a denser open-throttle charge. Failure to compress a fuel-air mixture to a given high pressure at the time of firing results in inefficient burning of the fuel with consequent wastage and exhaust pollution problems.

Another objectionable feature of present day internal combustion engines is the excess wear and loss of power caused by lateral or radially directed forces applied to the piston through the connecting rod as it oscillates laterally back and forth through the axis of the cylinder. Any time the connecting rod occupies an angular position with respect to the axis of the cylinder, it exerts a radial component of force on the piston causing increased "drag" against the wall of the cylinder. Ideally, friction and resultant wear between the piston and cylinder walls would be materially reduced if the connecting rod could be arranged to reciprocate in a straight line coincident with the axis of the cylinder.

Another major problem of present day four-cycle internal combustion engines is the inefficient scavenging of exhaust gases from the combustion cylinder prior to the induction of the next fuel charge. In an effort to improve exhaust gas scavenging, the exhaust valve of the conventional four cycle engine is usually timed to open long before the piston reaches bottom dead center at the end of the power stroke. While premature opening of the exhaust valve during the power stroke improves exhaust gas scavenging, it also results in considerable loss of power since the driving force of each piston is applied to the crankshaft for only approximately 130°-150° out of a total 720° of rotation of the crankshaft. Accordingly, the efficiency of a four-cycle internal combustion engine would be materially increased if the driving force of the piston could be applied to the crankshaft over a longer arc of revolution.

SUMMARY AND OBJECTS OF THE INVENTION

In accordance with this invention, an internal combustion engine is provided with a crankshaft which is journaled for rotation about an axis perpendicular to but laterally offset from the axis of the combustion cylinder of the engine. The crankshaft is connected with the engine piston by means of an articulated connecting rod or linkage whose pattern of movement may be varied by an automatic control, so as to adjust the stroke of the piston to the density of the influent fuel charge. The improved articulated connecting rod linkage and control mechanism of this invention operates to vary the stroke of the engine piston so that a rarer (low throttle) fuel-air charge inducted into the cylinder will be compressed to substantially the same pressure at the time of firing as is a denser (open throttle) fuel-air charge.

The principal object of this invention is to provide an internal combustion engine of materially higher efficiency as compared with present day internal combustion engines, and in which frictional heat losses and wear between the piston and cylinder walls is materially reduced, and in which fuel is more efficiently burned and utilized, particularly under low or closed throttle conditions.

Additional objects and advantages will become more readily apparent by reference to the following description and the accompanying drawings.

DESCRIPTION OF PREFERRED EMBODIMENT OF THE INVENTION

Figure 2:
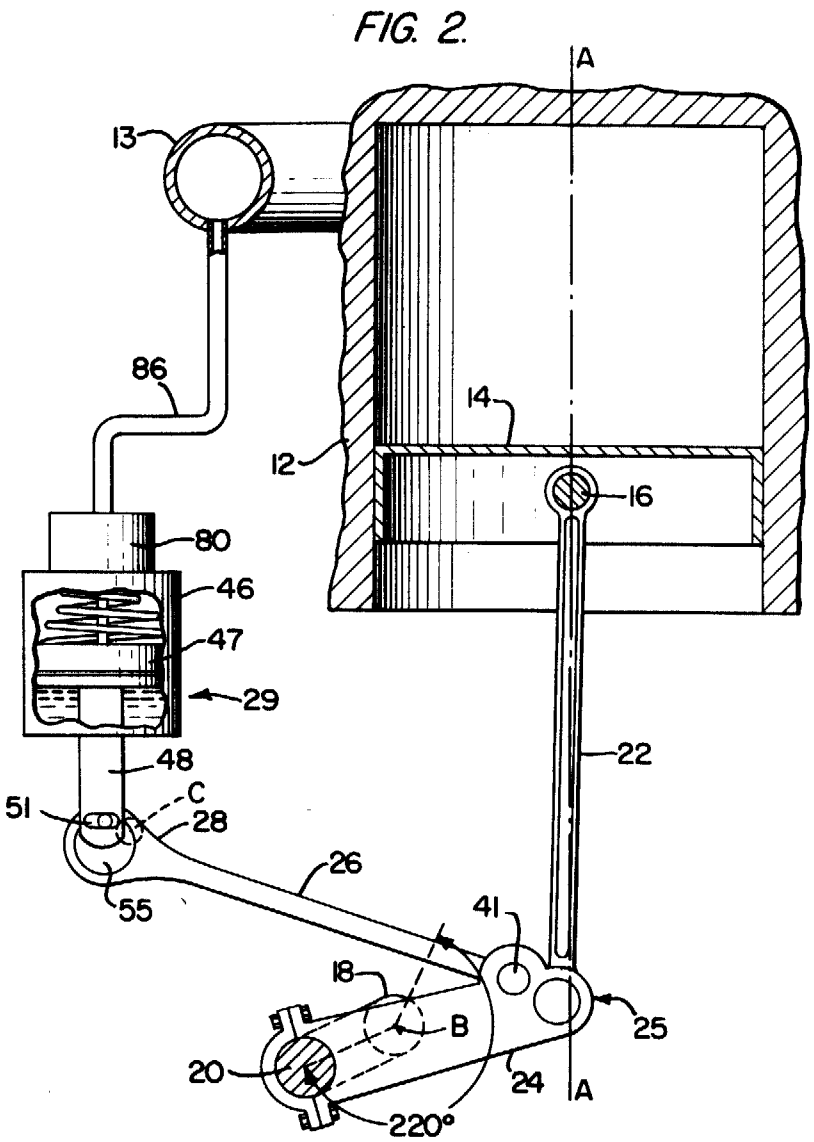
FIGS. 1 and 2 are schematic vertical sectional views of an internal combustion engine according to this invention and showing, respectively, the engine piston at top and bottom dead center positions with the stroke control in low or closed throttle condition.

With reference to the drawings, it will be seen that the present internal combustion engine comprises one or more combustion cylinders 12 into which a combustible fuel-air mixture may be inducted by way of a fuel intake manifold or other fuel induction passage means 13. A piston 14 is arranged to reciprocate along the axis A—A of the cylinder and is provided with the usual diametrically arranged wrist pin 16. The engine also includes a conventional crankshaft 18 journalled for rotation about an axis B disposed in perpendicular, but laterally offset relation to the axis A—A of the cylinder 12. The crank-shaft 18 includes one or more throw journals 20.

An articulated or jointed connecting rod extends between the piston 14 and the throw journal 20 of the crankshaft 18, and is made up of a pair of lever sections 22 and 24 which are hingedly connected to one another to form a knee joint 25. The lever sections 22 and 24 are rotatively connected, respectively, with the wrist pin 16 and the throw 20 of the crankshaft 18. An elongated, rigid guide rod 26 includes an inner, forked, or bifurcated end portion 27 (see FIG. 9) pivotally secured to the crankshaft-connected lever section 24, and an outer end portion 28 pivotally secured to a pressure-responsive servomotor control, indicated generally by reference numeral 29. As will be noted, the guide rod 26 extends laterally outwardly from and in angular relation to the lever sections 22 and 24 toward the same side of the axis A—A of the cylinder as the crankshaft, and the guide rod 26 is arranged to oscillate in the space between the cylinder 12 and crankshaft 18 of the engine.

Figure 8:
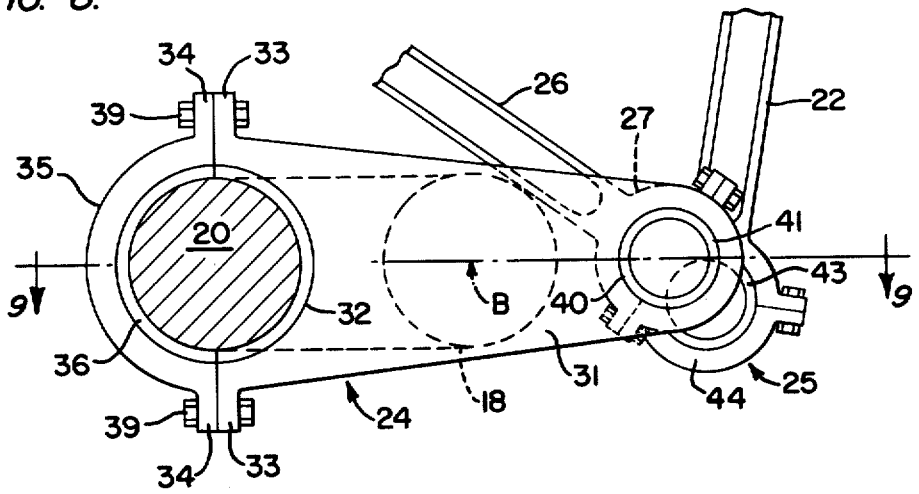
FIG. 8 is an enlarged, fragmentary vertical sectional view taken through one of the throw journals of the crankshaft and showing particularly the crankshaft-connecting portion of the articulated connecting rod.
Figure 9:
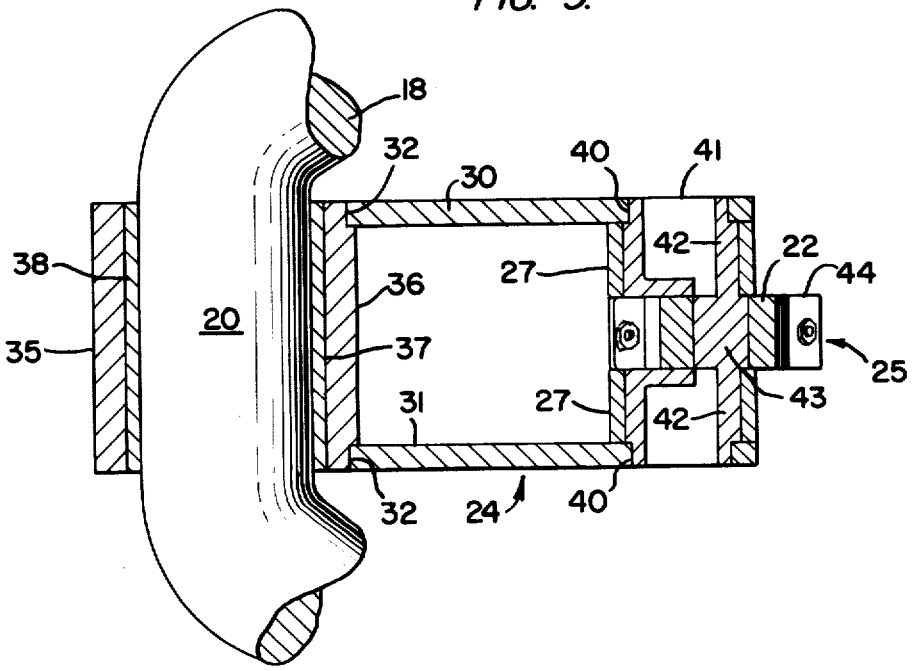
FIG. 9 is a horizontal sectional view taken approximately along the line 9—9 of FIG. 8.

FIGS. 8 and 9 of the drawings illustrate a preferred construction for the crankshaft-connected lever section 24 of the connecting rod. The lever section 24 preferably comprises a pair of spaced apart, longitudinally tapered side plates 30 and 31 which are formed at their larger ends with semicircular recesses 32 and a pair of radially outwardly projecting, bolt-receiving bosses 33. The bolt-receiving bosses 33 are arranged to mate with complemental bosses 34 formed on a semi-circular clamp section 35. The recesses 32 formed in the side plates 30 and 31 receive and retain therein a semi-cylindrical bushing 36 which is provided with an inner, semi-cylindrical wear liner or bearing segment 37. The clamp member 35 is also provided on its inner arcuate surface with a coextensive semi-cylindrical wear liner or bearing segment 38. The clamp and bushing segments 35 and 36 embrace the throw journal 20 of the crankshaft 18, and the clamp segment 35 is secured to the side plates 30 and 31 by means of bolts 39 passed through the mating bosses 33 and 34.

At their opposite ends, the side plates 30 and 31 are formed with registering openings 40 into which are press fitted the shouldered ends of a tubular pivot pin 41. As shown particularly in FIG. 9, the pivot pin 41 is formed at the ends thereof with a pair of axially aligned journals 42 to pivotally receive and support the bifurcated end portions 27 of the guide rod 26, and the journals 42 are separated by an intermediate, radially offset journal portion 43 to which the lower end of the lever section 22 is pivotally secured by means of a detachable clamp segment 44. In this manner, the pivotal connection or knee joint 25 between the lever sections 22 and 24 of the connecting rod is relatively offset from and balanced between the pivotal connections between the guide rod 26 and the lever section 24. Thus, the preferred construction of the lever section 24 as shown in FIGS. 8 and 9 provides a balanced system through which forces transmitted through the piston-driven lever section 22 may be distributed to the throw 20 of the crankshaft 18.

Figure 6:
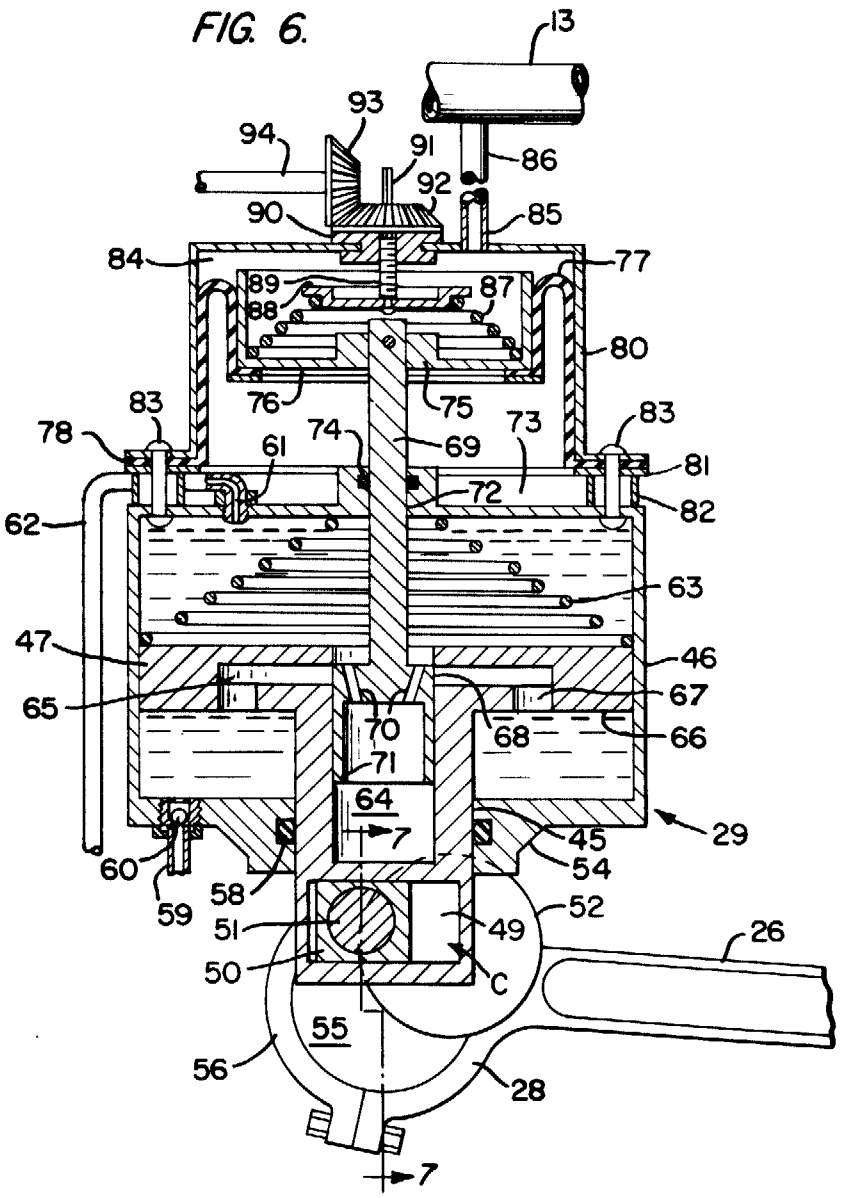
FIGS. 5 and 6 are comparative vertical sectional views taken through a preferred stroke control mechanism and showing the control mechanism under relatively open and closed throttle conditions, respectively.
Figure 5:
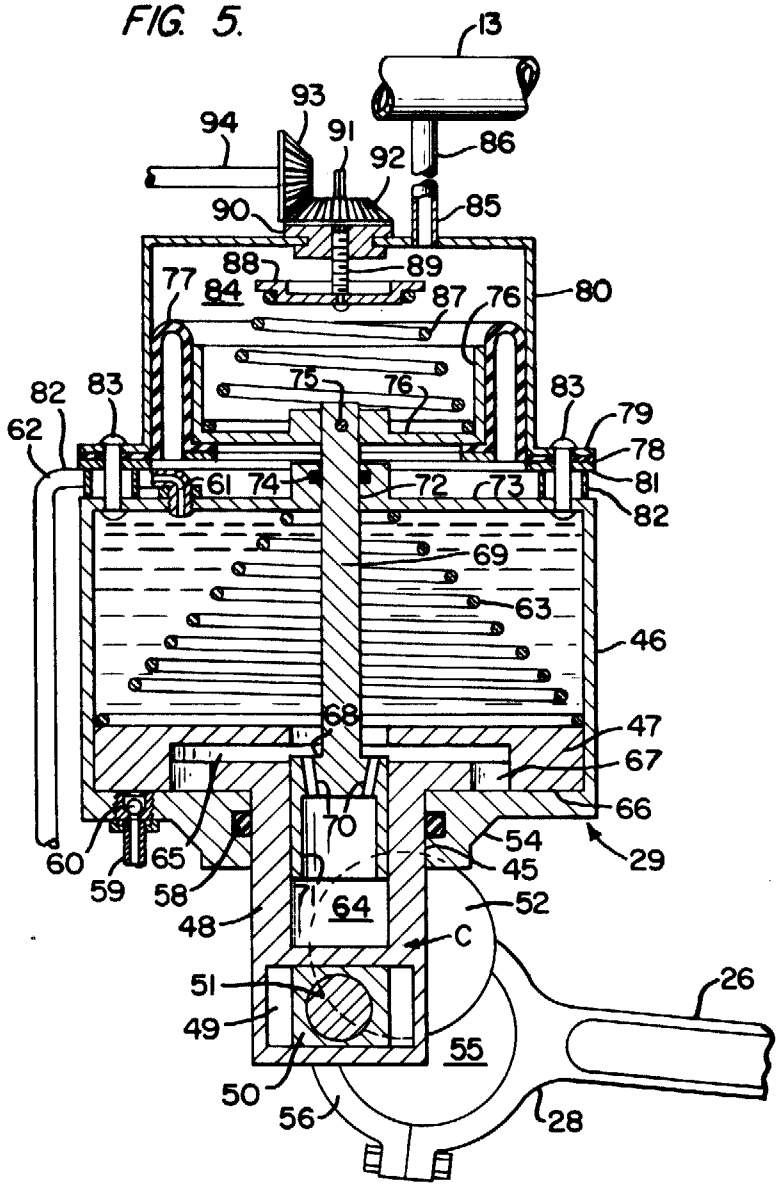

Turning now to FIGS. 5 and 6 of the drawings, it will be noted that the pressure-responsive servomotor control 29 comprises an hydraulic cylinder 46 in which is slidably positioned a piston 47. The piston 47 is formed with an axially depending, cylindrical stem or rod portion 48 which extends through a central opening 45 formed in bottom wall 54 of the cylinder 46, and whose lower end is formed with a laterally opening, rectangular slot 49. The slot 49 defines a slide or guide way for a sliding block member 50 in which is pivotally journalled a crank pin 51. As will be readily apparent, the rectangular guide way 49, sliding block 50 and crank pin 51 define what is commonly known as a Scotch yoke disposed in the lower end of the stem 48 of the piston 47. The depending stem portion 48 of the piston 47 is slidable within the central bore 45 formed in the bottom wall 54 of the cylinder 46, and a resilient O-ring 58 provides a fluid tight seal between the stem portion 48 and the bottom wall 54 of the cylinder.

Figure 7:
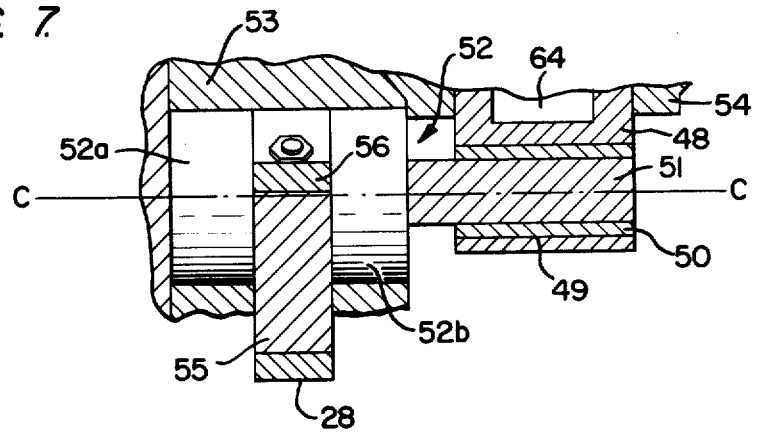
FIG. 7 is a fragmentary vertical sectional view taken along the line 7—7 of FIG. 6 and showing particularly the Scotch yoke portion of the stroke control.

As best seen from FIG. 7, the crank pin 51 forms an integral part of, and projects outwardly from one end of an eccentric shaft 52 having a pair of relatively spaced, cylindrical journals 52*a* and 52*b* mounted for axial rotation in a stationary bearing 53 located adjacent the bottom wall 54 of the cylinder 46. The crank pin 51 is disposed in offset, eccentric relation to the axis of rotation C of the shaft 52 and is arranged to move in a limited arcuate path upon vertical movement of the stem 48 of the piston 47. Also forming an integral part of the shaft 52 is a second, relatively larger diameter eccentric crank 55. The outer end portion 28 of the guide rod 26 is pivotally secured to the larger diameter eccentric crank 55 of the shaft 52 by means of a bearing clamp segment 56. Thus, the smaller diameter crank pin 51 is arranged to move in an arcuate path upon vertical upward and downward movement of the stem 48 of the piston 47, and such movement of the crank pin 51 causes the shaft 52 to oscillate about its axis C. This movement causes the larger diameter eccentric journal 55 of the shaft to oscillate in an arcuate path and thereby move the guide rod 26 inwardly or outwardly with respect to the axis A—A of the engine cylinder. As will be hereinafter more fully explained, the inward and outward adjustment of the guide rod 26 changes the relative angularity of the lever sections 22 and 24 of the connecting rod, and thus varies the stroke pattern of the engine piston 14 within the cylinder 12 of the engine.

Extending through the bottom wall 54 of the cylinder 46 is a fluid inlet conduit 59 which is connected to receive lubricating oil under pressure from the crankcase of the engine. The inlet conduit 59 is provided with a ball-type check valve 60 arranged to prevent the outflow of oil from the cylinder 46, while permitting free in-flow of oil therein. The cylinder 46 is also provided at its upper end with a relatively restricted oil outlet port 61 which is in communication with an oil return pipe or conduit 62. A coiled compression spring 63 is positioned within the hydraulic cylinder 46 between the upper wall of the cylinder and the upper face of the piston 47, and is arranged to bias the piston 47 with considerable force toward the bottom wall 54 of the cylinder. The piston 47 and its depending stem 48 are formed with a centrally located, cylindrical bore or valve chamber 64 which terminates above the slot 49 of the valve stem 48. The piston 47 is also formed a distance below its upper face with an annular pressure relief chamber 65 which is in radial communication with the valve chamber 64 and a series of relatively large diameter ports 67 formed in the bottom face 66 of the piston. Slidably carried in the valve chamber 64 of the piston is a pilot valve 68 which includes an elongated, upwardly extending stem 69. The head portion of the pilot valve 68 is formed with a pair of relief ports or passages which provide free fluid communication between the valve chamber 64 and the main fluid chamber of the cylinder 46. Preferably, the head portion of the pilot valve 68 is formed with an elongated skirt 71 which provides an axially extended bearing surface between the head of the valve 68 and the side wall of the chamber 64. The elongated stem 69 of the pilot valve 68 extends outwardly through and is slidable in a central bore formed through the upper wall 73 of the cylinder 46. An O-ring seal 74 provides a fluid tight seal between the upper wall 73 of the cylinder and the relatively slidable stem 69 of the pilot valve. The upper end of the stem 69 of the pilot valve is rigidly secured by a drive pin or rivet 75 to a generally cylindrical, cup-shaped center pan 76 of a flexible diaphragm 77. The outer marginal edge portion 78 of the diaphragm is rigidly secured and sandwiched between the radial base flange 79 of a cylindrical diaphragm housing or cover 80 and a clamping ring 81. The diaphragm 77 and housing 80 are positioned in elevated relation to the upper wall 73 of the cylinder 46 by means of spacer rings 82. The diaphragm housing 80, marginal edge portion 78, clamp ring 81 and spacer rings 82 are fixedly secured to the upper wall 73 of the cylinder 46 by means of a plurality of circumferentially spaced rivets or bolts 83. In this manner, the undersides of the diaphragm 77 and its center pan 76 are exposed to atmospheric pressure at all times.

The housing or cover 80 defines with the diaphragm 77 and center pan 76 a vacuum chamber 84 which is provided with an inlet port 85. The inlet port 85 is connected by a flexible tube or conduit 86 with the intake manifold or fuel induction passage means 13 of the engine. A compression spring 87 is positioned between the upper side of the diaphragm center pan 76 and a vertically adjustable retainer plate 88 rotatably carried at the lower end of a screw-threaded shaft 89. The shaft 89 is threaded through a grommet-type bushing 90 sealed within an opening formed in the upper wall of the housing 80. Above the bushing 90, the shaft 89 is formed with a square or multi-angular drive section 91 which extends through a cooperatively shaped, multi-angular opening formed axially through a driven bevel gear 92. The gear 92 meshes with a second drive gear 93 drivingly carried at the end of a remotely extending central shaft 94. Advantageously, the shaft 94 may extend to the control panel or dash board of a vehicle in which the engine is mounted, where it may be manually rotated by the operator of the engine. Rotation of the shaft 94 and gears 92 and 93 functions to rotate the screw shaft 89 and adjust the plate 88 upwardly or downwardly in the housing 80 to thereby vary the force exerted by the spring 87 upon the diaphragm center pan 76.

Operation:

In operation, the stroke of the piston(s) 14, and hence, the displacement of the engine, is adjusted automatically in accordance with the pressure of the fuel-air mixture within the intake manifold or fuel induction passage 13 of the engine, so that low density, low throttle fuel charges will be compressed to substantially the same pressure at the time of firing as relatively higher density, open throttle charges.

FIG. 6 of the drawings illustrates the servomotor control 29 in a low throttle (fast idle) condition, while FIG. 5 shows the control 29 in an open or full throttle condition. As will be noted, the under face 66 of the piston 46 is in constant communication with and is subject to the pressure of the lubricating oil within the crankcase of the engine, while the upper side of the diaphragm 77 is in constant communication with and subject to the pressure of gaseous fluid within the fuel intake manifold or induction chamber 13 of the engine. Thus, under low throttle conditions the pressure within the intake manifold 13 and within the diaphragm chamber 84 will be considerably below atmospheric pressure, and the diaphragm 77 and its center pan 76 will be raised or elevated within the housing 80, since the under side of the diaphragm and center pan 76 are subject to atmospheric pressures at all times. Upward movement of the diaphragm 77 and its center pan 76 is resiliently resisted by the compression spring 87 whose pressure may be manually adjusted through the screw shaft 89 and beveled gear train 92 and 93. The valve stem 69 and valve head 68 move vertically with the diaphragm, and when the valve head 68 moves upwardly to a position at which it closes the relief chamber 65 of the piston 47, the piston 47 moves gradually upwardly within the cylinder 46 as the force exerted upon the under face 66 of the piston by the pressure of the crankcase lubricating oil exceeds the force of the spring 63. The piston 47 will continue to move slowly upwardly until such time as the relief chamber 65 moves slightly beyond the upper shoulder of the valve head 68 to permit restricted flow of oil under pressure into the upper portion of the cylinder 46 and thence outwardly through the restricted outlet port 61. In other words, any time that the upper shoulder of the valve head 68 occupies a position in which the relief chamber 65 is open, the pressure of oil beneath the piston 47 is relieved, and the spring 63 will immediately thrust the piston 47 downwardly until the relief chamber 65 is once again closed, or until the piston 47 bottoms against the bottom wall 54 of the cylinder, In FIG. 5, the diaphragm 77, the valve 68 and the piston 47 have moved downwardly to their bottom-most positions in response to the increase in pressure within the diaphragm chamber 84 and the fuel intake manifold 13 of the engine occasioned by the full opening of the throttle of the engine.

As will be appreciated, the relatively large size of the ports 67, manifold chamber 65 and valve chamber 64 permits the unrestricted flow of oil through the piston when the valve head 68 moves downwardly to open the relief chamber 65. Thus, the piston 47 will move in a downward direction substantially instantaneously in response to an increase of pressure within the diaphragm chamber 84 and the fuel induction means 13 occassioned by the opening of the throttle of the engine. Conversely, the restricted outlet port 61 of the cylinder 46 retards the movement of the piston in an upward direction and thus slows the operation of the control 29 in response to decreasing pressures within the fuel induction system of the engine occassioned by movement of the throttle toward closed position. The substantially immediate response of the servomotor control 29 to open throttle movement is highly important, since it guards against excessive and possibly destructive combustion pressures in the engine cylinder(s) which might otherwise result from a time lag between the opening of the engine throttle and the adjustment of the connecting rod levers to provide maximum head space when the engine piston 14 reaches a top dead center position.

As will be apparent, the stem portion 48 of the piston 47 and the crank pin 51 of the eccentric shaft 52 will move upwardly and downwardly in relation to the vertical movement of the piston 47 and the valve 68. Thus, when the valve 68 moves upwardly in response to a reduction in pressure within the diaphragm chamber 84 and the fuel intake manifold 13, the crank pin 51 moves in an upward clockwise arc about the axis of rotation C of the shaft 52, and this causes the eccentric journal 55 to move in a corresponding clockwise arc which displaces the guide rod 26 leftwardly as viewed from FIG. 5. Conversely, when the valve 68 moves downwardly in response to an increase of pressure within the diaphragm chamber 84 and fuel intake manifold 13, the crank pin 51 will move immediately in a downward, counter clockwise arc, causing the eccentric journal 55 to move rightwardly as viewed from FIG. 6.

Figure 1:
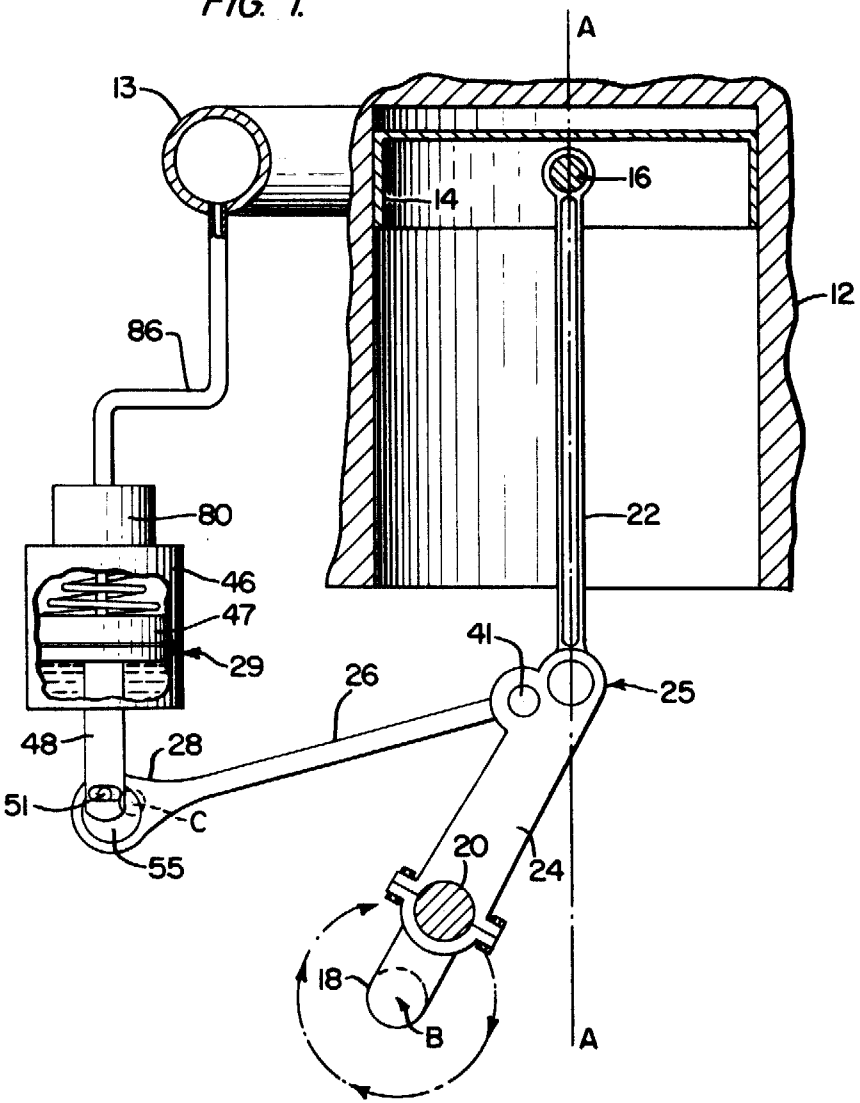
Figure 4:
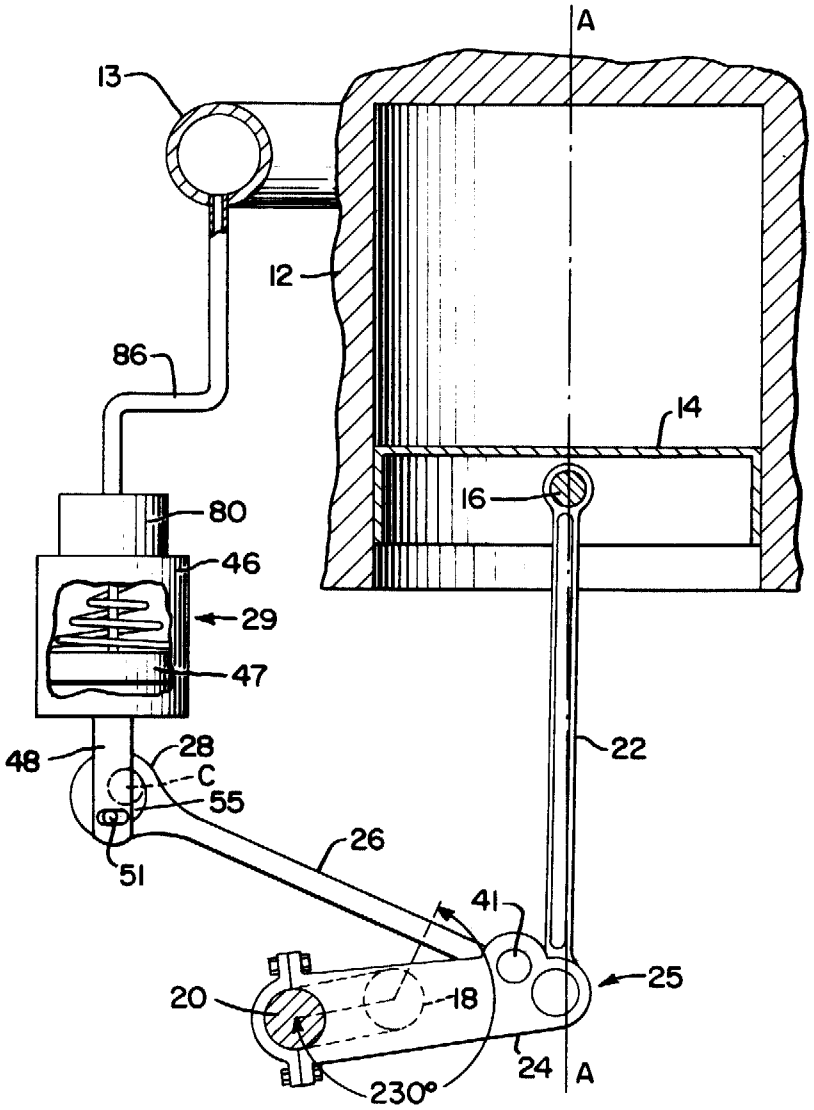
FIGS. 3 and 4 are similar comparative views showing, respectively, the top and bottom dead center positions of the piston with the stroke control in open throttle condition.
Figure 3:
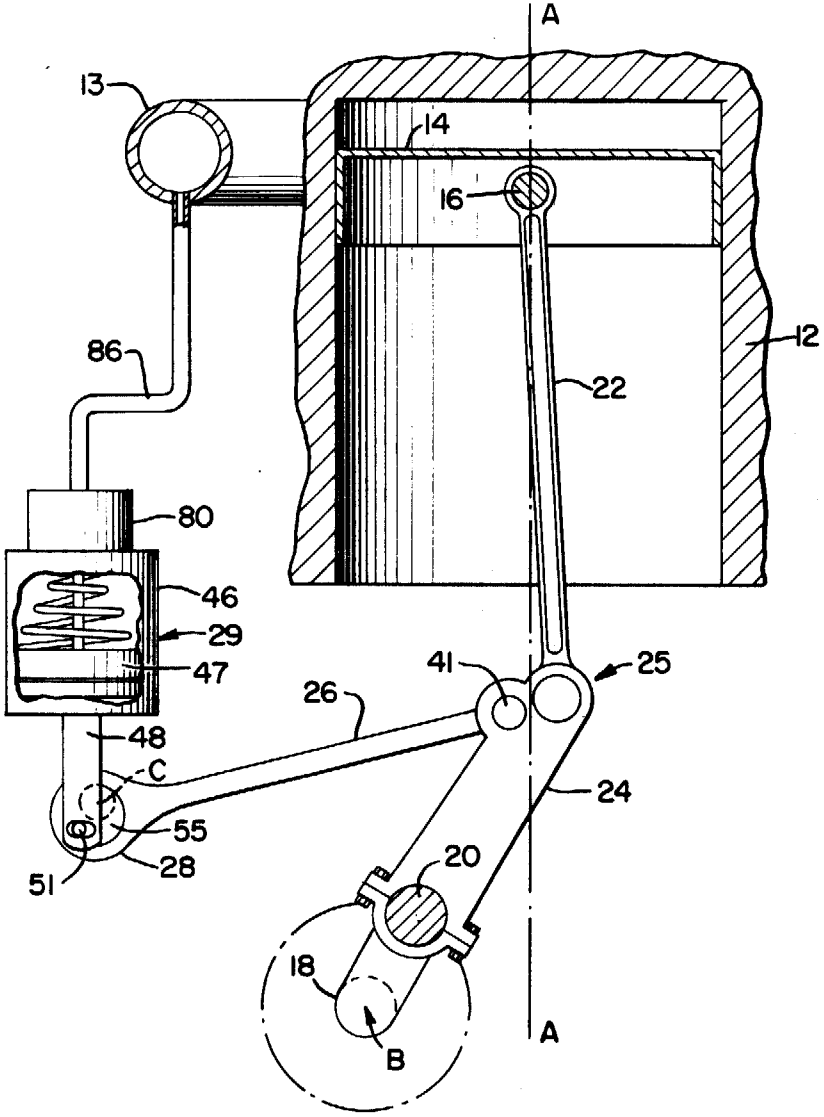
Figure 10:
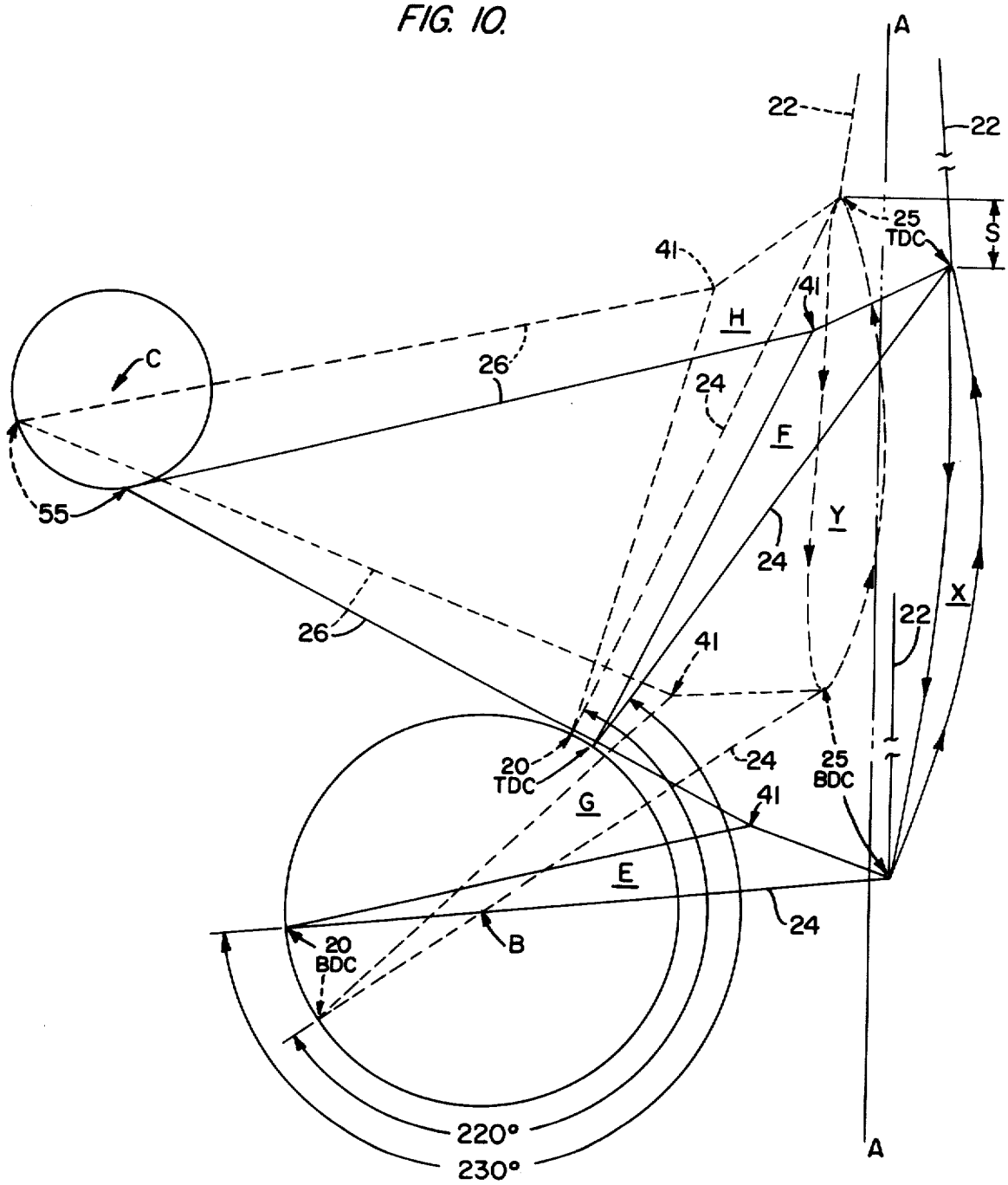
FIG. 10 is a geometric diagram showing changes in the pattern of movement of the articulated connecting rod resulting from open and closed throttle operating conditions of the engine.

FIG. 10 of the drawings illustrates the change in the pattern of movement of the articulated connecting rod as between full throttle engine conditions, as shown by full lines, and approximately ¼ throttle (fast idle) operating conditions as illustrated by broken lines. Solid line triangles E and F illustrate the bottom dead center and top dead center positions, respectively, of the connecting rod lever section 24 with the servomotor control 29 in full open throttle condition. The broken line triangles G and H show the bottom dead center and top dead center positions, respectively, of the connecting rod lever section 24 with the servomotor control 29 in ¼ throttle condition. FIGS. 1 and 2 of the drawings also show the relative positions of the connecting rod lever sections 22 and 24 when the piston 14 occupies top dead center and bottom dead center positions, respectively, and with the servomotor control 29 responding to relatively low or closed throttle conditions. FIGS. 3 and 4 are similar views showing the top and bottom dead center positions, respectively, of the piston 14 when the servomotor control 29 responds to full throttle conditions.

From FIG. 10, it will be noted that when the eccentric crank 55 of the servomotor control 29 is shifted rightwardly in response to an open throttle, the knee joint 25 between the lever sections 22 and 24 of the connecting rod will describe a vertically elongated, narrow loop X during each complete revolution of the crankshaft 18. It will also be noted that the loop X is disposed slightly to the right of the axis A—A of the cylinder 12. Conversely, when the eccentric crank 55 is shifted leftwardly in response to ¼ throttle condition of the servomotor control 29, the knee joint describes a somewhat shorter and wider loop Y disposed slightly to the left of axis A—A of the cylinder 12. It will further be noted that each time the knee joint 22 and the piston 14 move from top dead center to bottom dead center positions with the servomotor control in full throttle condition, the throw 20 of the crankshaft 18 will move clockwise through an arc of approximately 230°. By the same token, when the servomotor control 29 is in a low (approximately ¼) throttle condition, the crankshaft throw will rotate through an arc of approximately 220° upon each down stroke (top dead center to bottom dead center) of the piston 14. Regardless of the position of the servomotor control, the knee joint 25 will descend the left sides of the loops X and Y upon the down strokes of the piston and will ascend the right sides of said loops upon the upward strokes of the piston.

It is significant to note by comparison of FIGS. 1, 2, 3 and 4 and the loops X and Y of FIG. 10, that under full throttle conditions of the servomotor control 29, the stroke of the knee joint 25 (loop X), and hence of the piston 14, is materially longer than it is with the servomotor control 29 responding to a low throttle condition (loop Y). At the same time, the head space between the piston 14 and the cylinder head at top dead center (FIGS. 1 and 3) is materially less with the control 29 in low throttle condition than it is with the control 29 in full throttle condition. The reduction in head space is indicated by dimension S in FIG. 10. This reduced head space (FIG. 1) causes a less dense (low throttle) fuel-air charge to be compressed to substantially the same pressure at the time of firing as a denser (full throttle) fuel-air charge is compressed in the relatively larger head space (FIG. 3).

It is also important to note that by properly formulating the dimensions of the crankshaft throw 20, the guide rod 26, the lever sections 24 and 22 of the connecting rod and the relative locations of the fixed axes A—A, B and C, the piston-connected lever section 22 of the connecting rod may be caused to reciprocate in a path almost coincident with the axis A—A of the cylinder, to thus minimize the application of side thrust forces against the piston 14 during its reciprocation within the cylinder 12. In other words, the dimensions and relative locations of the articulated connecting rod levers 22 and 24, crankshaft 18, guide rod 26, and the eccentric journal 55 of the servomotor control 29 may be formulated to provide for reciprocation of the connecting rod lever section 22 substantially along the axis A—A of the cylinder under a selected throttle condition, e.g., ½ throttle.

The relatively extended 220°-230° rotation of the crankshaft throw during the down strokes of the piston 14 is of particular advantage since it enables the force applied by the piston during its power stroke to be transmitted over a proportionately longer arc of rotation of the crankshaft, while at the same time affording ample time for the efficient scavenging of exhaust gases from the cylinder during the latter part of the power stroke and the succeeding exhaust stroke of the piston.

In view of the foregoing, it will be seen that the present invention provides a highly efficient four-cycle internal combustion engine whose stroke and displacement is automatically varied in accordance with the density (pressure) of the inducted fuel-air mixture to provide for optimum compression and efficient burning of low throttle fuel charges as well as open throttle fuel charges. The present combustion engine is further characterized by a material reduction in side thrust forces applied to the piston during reciprocation thereof within the cylinder, and a consequent reduction in the amount of wear and heat loss caused by piston side thrust in the conventional four-cycle internal combustion engine. Further, by utilizing a connecting rod linkage which is operable to rotate the crankshaft through a comparatively longer arc during the down strokes of the piston and a comparatively shorter arc during the up strokes thereof a greater percentage of the power derived from the burning of the fuel may be applied to the crankshaft of the engine.

While a single preferred embodiment of the invention has been illustrated and described in detail, it will be understood that various modifications in details of construction and design are possible without departing from the spirit of the invention or the scope of the following claims.

I claim:

1. In an internal combustion engine which includes a combustion cylinder, fuel induction means for conducting fuel to said cylinder, a piston movable in opposite directions along the axis of said cylinder, and a crankshaft stationarily journalled for rotation about a single axis disposed in right angular relation to the axis of said cylinder; that improvement which comprises:

(a) an articulated connecting rod consisting of two hingedly connected, angularly related levers extending between and pivotally connected, respectively, with the piston and crankshaft of said engine;

(b) an elongated guide rod pivotally connected at one end thereof to the crankshaft-connected lever of said connecting rod adjacent the hinge connection between said levers and having an opposite end extending generally laterally outwardly from said levers; said guide rod being movable longitudinally to vary the stroke of the piston within the cylinder of said engine; said guide rod and said articulated connecting rod being arranged to rotate said crankshaft through an arc substantially greater than 180° upon a full stroke of said piston in one direction and through an arc substantially less than 180° upon a full stroke of said piston in the opposite direction; and (c) control means connected with the opposite end of said guide rod and operable to move said guide rod longitudinally in response to variations of pressure within the fuel induction means of said engine.

2. In an internal combustion engine having a combustion cylinder, fuel induction means for conducting fuel to said cylinder, a piston reciprocable axially within said cylinder, and a crankshaft stationarily journalled for rotation about a single axis disposed in perpendicular, but laterally offset relation to the axis of said cylinder; that improvement which comprises:

(a) a first, elongated lever extending generally along the axis of said cylinder and having one end thereof pivotally connected with said piston;

(b) a second elongated lever disposed in obtusely angular relation to said first lever and having one end thereof journalled to said crankshaft and an opposite end hingedly connected to the opposite end of said first lever;

(c) an elongated guide rod having one end thereof pivotally connected to said second lever adjacent the hinge connection between said first and second levers and an opposite end portion extending outwardly in acutely angular relation to said second lever and in the same general direction in which said crankshaft is offset from the axis of said cylinder; said first and second levers and said guide rod being arranged to rotate said crankshaft through an arc substantially greater than 180° upon a full stroke of the engine piston in one direction and through an arc substantially less than 180° upon a full stroke of said piston in the opposite direction; and (d) control means pivotally connected with the opposite end of said guide rod and operable to adjust the stroke of said piston in response to variations in the pressure of fuel within the fuel induction means of said engine.

* * * * *